US007665263B2

(12) United States Patent
Yau

(10) Patent No.: US 7,665,263 B2
(45) Date of Patent: Feb. 23, 2010

(54) HARDWOOD FLOORING SYSTEM

(76) Inventor: Paul Yau, 2350 S. Watney Way, #B, Fairfield, CA (US) 94533

( * ) Notice: Subject to any disclaimer, the term of this patent is extended or adjusted under 35 U.S.C. 154(b) by 325 days.

(21) Appl. No.: 11/671,134

(22) Filed: Feb. 5, 2007

(65) Prior Publication Data

US 2008/0184647 A1 Aug. 7, 2008

(51) Int. Cl.
*E04C 3/00* (2006.01)

(52) U.S. Cl. ..... 52/578; 52/589.1; 52/591.1

(58) Field of Classification Search ..... 52/589.1, 52/591.1, 592.1, 578, 384
See application file for complete search history.

(56) References Cited

U.S. PATENT DOCUMENTS

| | | | | | |
|---|---|---|---|---|---|
| 1,444,611 | A | * | 2/1923 | Johansson | 52/578 |
| 2,280,071 | A | * | 4/1942 | Hamilton | 52/578 |
| 2,729,584 | A | | 1/1956 | Foster | |
| 3,828,503 | A | * | 8/1974 | Hofmann | 52/393 |
| 4,416,100 | A | * | 11/1983 | Troendle, Sr. | 52/390 |
| 4,546,024 | A | * | 10/1985 | Brown | 428/44 |
| 4,554,769 | A | * | 11/1985 | Fujii et al. | 52/388 |
| 4,953,335 | A | * | 9/1990 | Kawaguchi et al. | 52/384 |
| 5,050,653 | A | * | 9/1991 | Brown | 144/351 |
| 5,103,614 | A | * | 4/1992 | Kawaguchi et al. | 52/392 |
| 5,109,898 | A | | 5/1992 | Schacht | |
| 5,497,590 | A | * | 3/1996 | Counihan | 52/385 |
| 5,671,575 | A | | 9/1997 | Wu | |
| 5,830,549 | A | * | 11/1998 | Sweet et al. | 428/40.1 |
| 6,119,423 | A | * | 9/2000 | Costantino | 52/390 |
| 6,135,531 | A | * | 10/2000 | Allen et al. | 296/39.1 |
| 6,182,413 | B1 | * | 2/2001 | Magnusson | 52/589.1 |
| 6,695,944 | B2 | * | 2/2004 | Courtney | 156/252 |
| 2001/0042350 | A1 | * | 11/2001 | Pacione | 52/506.1 |
| 2002/0152701 | A1 | * | 10/2002 | Zhang et al. | 52/390 |
| 2004/0074190 | A1 | | 4/2004 | Lin et al. | |
| 2004/0074191 | A1 | | 4/2004 | Garcia | |
| 2004/0226243 | A1 | | 11/2004 | Lin et al. | |

FOREIGN PATENT DOCUMENTS

| | | | |
|---|---|---|---|
| GB | 519198 | A1 | 3/1940 |
| GB | 753111 | A1 | 7/1956 |

* cited by examiner

*Primary Examiner*—David Dunn
*Assistant Examiner*—Joshua Ihezie
(74) *Attorney, Agent, or Firm*—Charles L. Thoeming

(57) ABSTRACT

An improved fabricated hardwood flooring product providing the advantage of a thick wood wear layer similar to a traditional ¾ inch solid wood floor with the dimensional stability characteristics of engineered wood floor products.

1 Claim, 4 Drawing Sheets

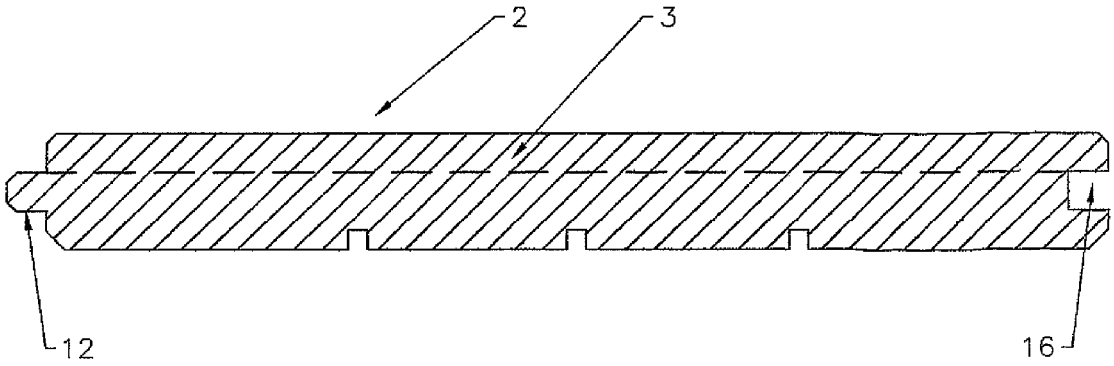
Fig 1 [PRIOR ART]
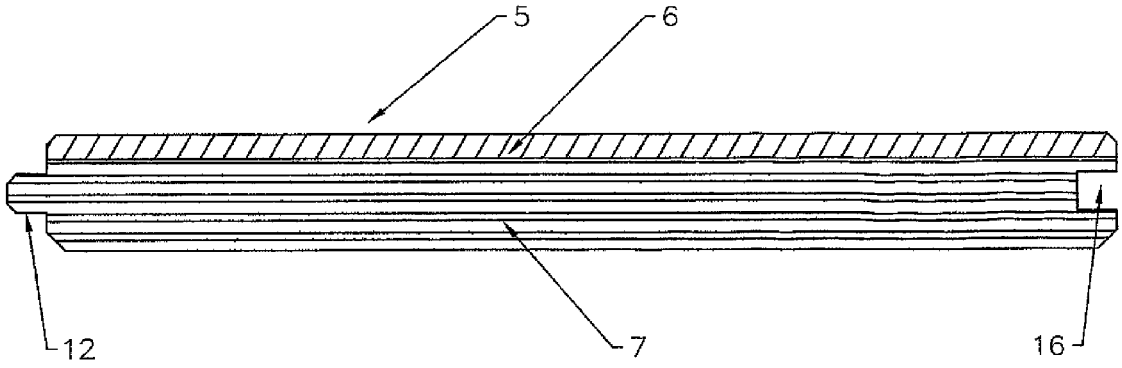
Fig 2 [PRIOR ART]

SECTION A–A

HARDWOOD FLOORING SYSTEM

CROSS-REFERENCES TO RELATED APPLICATIONS

None.

STATEMENT REGARDING FEDERALLY SPONSORED RESEARCH OR DEVELOPMENT

None.

REFERENCE TO A MICRO-FICHE APPENDIX

None.

TECHNICAL FIELD

This invention relates generally to wood flooring systems, and in particular, to an improved solid hybrid wood flooring product which combines the advantage of a thick wood wear layer similar to a traditional ¾ inch solid wood floor with the dimensional stability characteristics of engineered wood floor products, and which can be glued directly to concrete sub-flooring.

BACKGROUND OF THE INVENTION

The solid hybrid wood flooring system comprises a thick top layer of solid wood glued to a bottom layer of specially designed and modified solid wood. The top layer of an embodiment can be of any wood species and is approximately ¼ inch thick. This top layer thickness allows the end user to re-sand or re-finish the wood multiple times during the life of the wood floor, like solid wood flooring. The modified wood bottom layer comprises many small pieces of solid wood, glued together to make the layer. The grain of the wood comprising top layer and bottom layer are in parallel planar orientation, respectively.

When subjected to moisture, the top layer and each small piece of wood of the bottom layer will react and move in different directions, structurally pulling each other similar to the reaction of movements of the plywood layering of engineered wood floors, resulting in a dimensionally stable piece of solid wood flooring. The present invention can be installed by any traditional flooring methods, namely stapling, nailing, gluing, and floating.

The following Patents or Patent Publications are believed to be representative of the art: U.S. Pat. No. 6,162,312, issued Dec. 19, 2000; U.S. Patent Publication No. 2002/0152701, published Oct. 24, 2002; U.S. Pat. No. 6,878,228, issued Apr. 12, 2005; U.S. Pat. No. 5,736,227, issued Apr. 7, 1998; U.S. Pat. No. 5,738,924, issued Apr. 14, 1998; U.S. Pat. No. 5,736,218, issued Apr. 7, 1998; U.S. Pat. No. 4,831,806, issued May 23, 1989; U.S. Pat. No. 5,040,582, issued Aug. 20, 1991; U.S. Pat. No. 5,543,193, issued Aug. 6, 1996; U.S. Pat. No. 5,109,898, issued May 5, 1992; U.S. Patent Publication No. 2005/0268571, published Dec. 8, 2005; U.S. Pat. No. 6,695,944, issued Feb. 24, 2004; U.S. Patent Publication No. 2004/0074190, published Apr. 22, 2004; U.S. Pat. No. Des. 355,494, issued Feb. 14, 1995; and UK Patent Application Ser. No. GB 2,212,761, published Feb. 8, 1989.

BRIEF SUMMARY OF THE INVENTION

Two types of wood flooring products generally are available in the domestic market, FIGS. 1 and 2.

In the representative cross-sectional view of solid wood flooring 2, FIG. 1, the flooring is made from a piece of solid wood material. The total thickness of a solid wood plank is typically ¾ inch, and the plank further consists of tongue 12 and groove 16 construction. The top layer or upper portion 3 of the solid wood plank 2 enables the end-user to re-sand or refinish the layer during the lifetime of the wood floor, and is typically ¼ inch thick. Solid wood flooring is generally installed by nail or staple to plywood sub-floors. Since hardwood flooring is very sensitive to moisture, gluing it down to concrete sub-floors is not recommended.

Various attempts have been made to increase the stability of the wood floors. The most popular of these variations is engineered wood flooring, FIG. 2.

In the representative cross-sectional view of engineered hardwood flooring 5, FIG. 2, the flooring has a thin solid wood top layer 6 glued to the top surface of a core layer 7. The top layer 6 is typically 2 millimeters to 4 millimeters thick. The core layer 7 is typically ⅛ inch to k inch thick and consists of tongue 12 and groove 16 construction, and is usually made of plywood. Engineered wood flooring is typically about 9/16 inch thick, and is generally installed by nail, staple, glue or float to sub-floor surfaces.

The cross grain layer construction of the plywood in the core layer 7 gives engineered wood a certain level of dimensional stability; however, the quality and perceived value of engineered hardwood floors are less desirable than solid wood flooring, and long-term performance is unsatisfactory. Over time, normal wear and tear from use and any re-finishing can often damage the thin wood top layer 6, exposing the non-flooring material in the core layer 7.

American consumers have preferred and enjoyed using real solid hardwood floors for more than 100 years, but most modern home developers build homes on concrete slab base sub-flooring. Therefore, it would be highly desirable to have a flooring board or system comprising solid wood materials, and yet provide enough dimensional stability to be glued down on top of the concrete sub-flooring. Additionally, in order to make it more affordable so that more people can enjoy using it, the new wood floor board should cost less to manufacture while providing all the aesthetic features and performance characteristics of a solid hardwood floor. Further, the new flooring should allow the user to maintain it in a manner similar to traditional solid hardwood flooring.

It is, therefore, one object to provide a new and useful two-layer hardwood flooring system providing a thick hardwood wear layer capable of being glued directly to concrete sub-flooring surfaces.

A further object is to provide a hardwood flooring system with superior hydroscopic dimensional stability.

It is yet another object to provide a two-layer, solid hardwood flooring system that provides the durability and aesthetic performance characteristics of traditional hardwood flooring.

It is a further object to provide an improved flooring system that reinforces sustainable forest product harvest practices and other environmentally sound timber logging methods.

It is yet a further object to lower the production costs of real wood flooring products, allowing more versatility in hard wood flooring applications and availability to more consumers.

An improved hardwood flooring product and system is thus provided for direct adaptation to concrete sub-flooring. In its broad form, this improved flooring provides the quality, aesthetic and durability of a thick wear layer present in traditional solid hardwood flooring while also providing the dimensional stability of engineered wood flooring.

Related features, objects and advantages of the present invention will be apparent with reference to the following description and accompanying drawings.

BRIEF DESCRIPTION OF DRAWINGS

FIG. 1 is a cross-sectional view of conventional solid wood flooring.

FIG. 2 is a cross-sectional view of conventional engineered wood flooring.

DETAILED DESCRIPTION OF THE INVENTION

Figure 3:
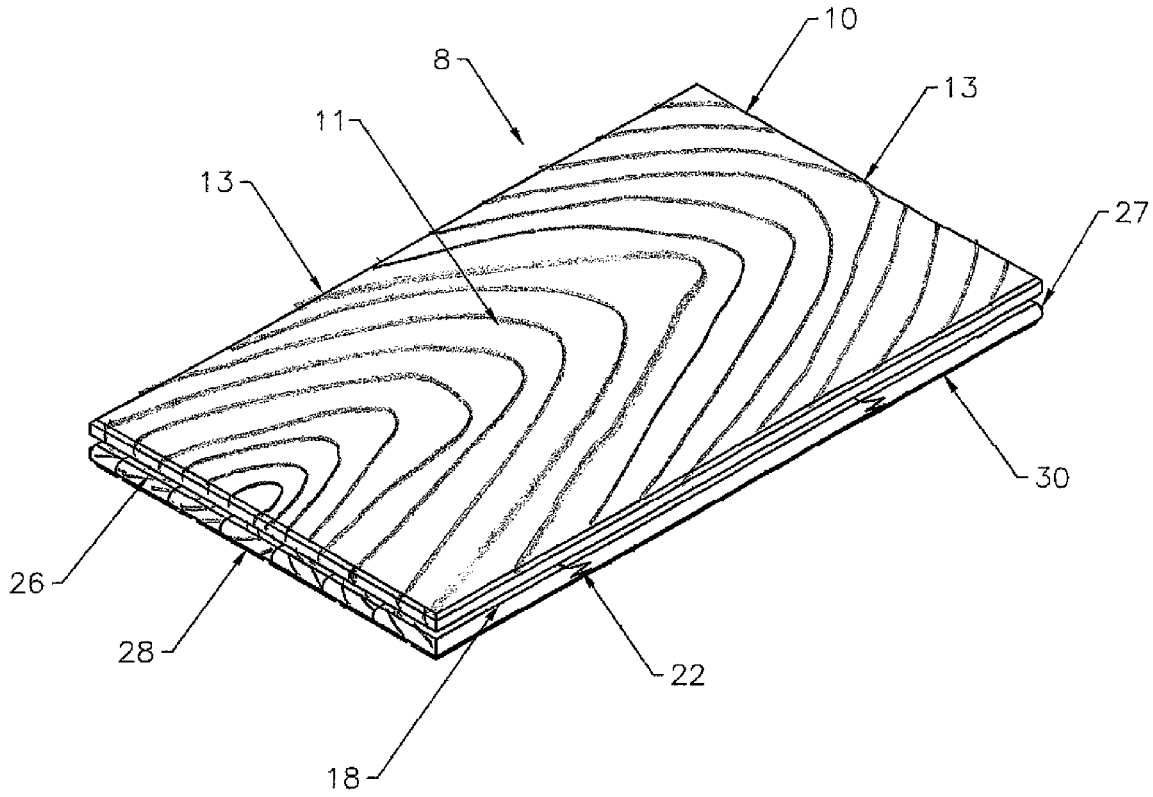
FIG. 3 is an isometric view of a wood floor plank constructed according to an embodiment of the present invention.

With reference to the drawings, an embodiment provides an improved and novel fabricated wood-flooring product 8, FIG. 3. The wood-flooring product 8 can be attached to any sub-floor including, but not limited to, concrete, wood, plywood, or oriented strand board ("OSB") by using traditional fasteners, such as nail, staple or glue. Each plank or board of wood-flooring product 8 is between 0.25 inch and 1 inch, and the preferred embodiment is 0.75 inch, in total thickness. The width of the plank or board of wood-flooring product 8 is from two inches to ten inches. The length of wood-flooring product 8 is generally from one foot to eight feet. The solid wood-flooring product 8 comprises a top layer 10 and a bottom layer 18. The top layer 10 is attached to the bottom layer 18 using conventional methods, such as adhesives, in conjunction with pressure so that the top layer 10 and bottom layer 18 are prevented from delaminating or separating from each other.

The top layer 10 is formed from a conventional hardwood flooring material in order to provide the desired durability and aesthetic appearance. Depending on the preference of color and/or wood grain, any wood flooring material can be chosen for the top layer 10. The top layer 10 has a thickness between two millimeters and eight millimeters. This thickness range allows the top layer 10 to be re-sanded or refinished approximately 2-6 times before it is completely sanded through. Thus, any scratches or similar surface damage to the top layer 10 can be readily repaired or resurfaced similarly to a conventional ¾ inch thick hardwood floorboard.

Figure 4A:
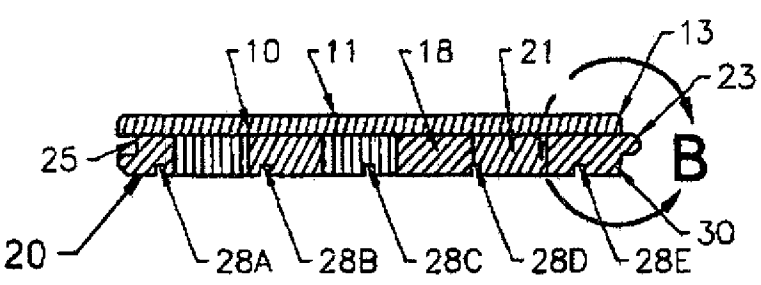
FIG. 4A is a cross-sectional view of the plank of FIG. 4 taken at "A-A."
Figure 4B:
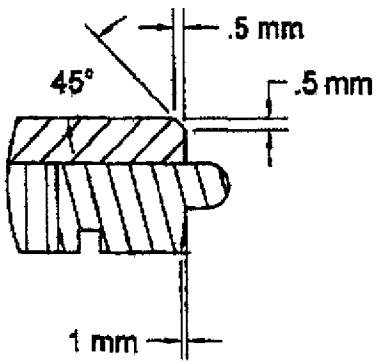
FIG. 4B is a detail view of the plank of FIG. 3 taken at B.
Figure 4:
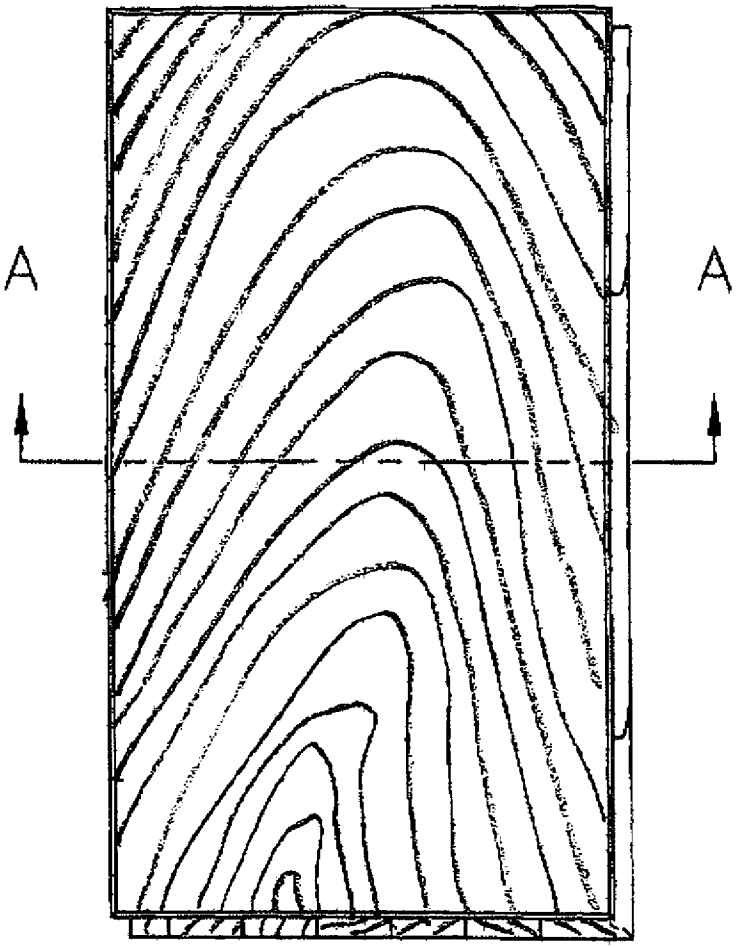
FIG. 4 is a top view of the plank of FIG. 3.

FIG. 4 illustrates a top view of the wood floor plank 8 showing the micro-bevel 13 around the entire perimeter of the top layer 10 of the wood floor plank 8. The micro-bevel 13 is cut at a 45 degree angle, and about 0.5 millimeter in width and depth, FIGS. 4A and 4B.

The top surface 11 of the top layer 10, FIGS. 3 and 4, is manufactured in several conventional styles, such as traditional smooth surface, wire-brushed or hand-scraped, and the surface 11 can be stained to different colors or unstained. Typically, five to nine coats of a non-toxic, ultraviolet cured urethane base finish, such as ceramic oxide and the like, are applied to the top surface 11. This finish provides a durable wear protection to the top surface 11.

The bottom layer 18, FIGS. 3 and 4, when glued to the top layer provides a tongue 23 and groove 25. The bottom layer 18 further comprising a plurality of small pieces of solid wood strips 21 glued together in a finger-jointed formation. This construction allows use of lower grade timber sources, reduces production costs, and increases the dimensional stability. As seen in FIG. 4A, these small strips 21 have a generally uniform square or rectangular cross-sections. Each strip 21 has a thickness ranging from a quarter inch to three-quarters inch, a width ranging from half an inch to two inches, and lengths ranging from four inches to thirty inches. Since the principal purpose of the bottom layer 18 is to support the top layer 10, wood strips 21 have no visual impact requirements. As the wood strips 21 are not visible after installation, lower grade solid wood materials can be used to form the bottom layer 18. These small wood strips 21 are arranged to have the same grain orientation and are parallel to each other in the same grain direction of the top layer 10.

Figure 5:
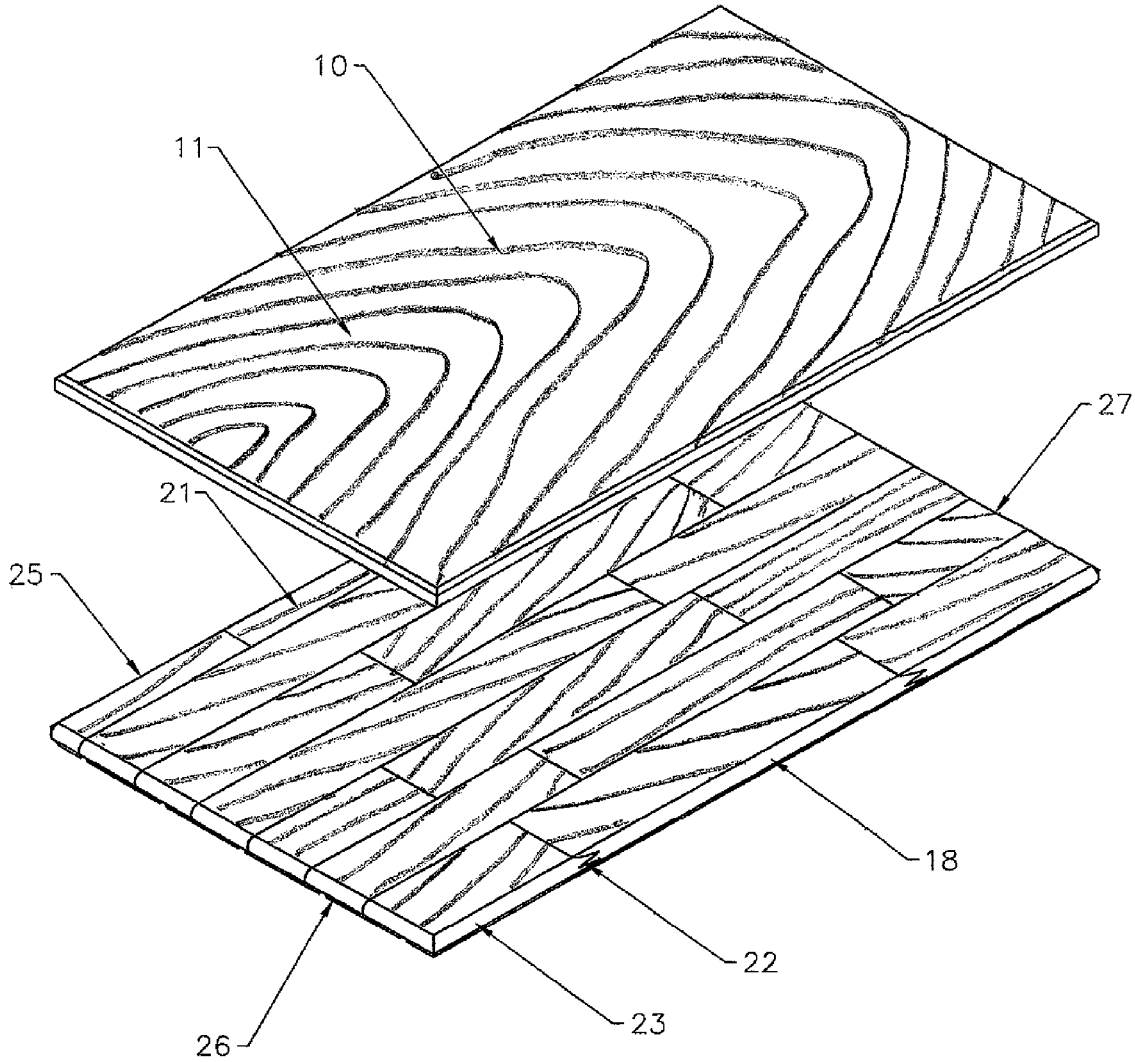
FIG. 5 is an exploded isometric view of the plank of FIG. 3.

The finger-jointed construction, FIGS. 3 and 5, method 22 is applied in the cutting and gluing of the small wood strips 21 to form the bottom layer 18. This method of cutting increases the adhesion surface area of each wood strip 21, which increases the bonding strength of the wood strips 21 after adhesive is applied. Further, the interlocking physical configuration of the finger-jointed 22 wood strips 21 also tends to minimize their hydroscopic movement, and which affords added dimensional stability to the bottom layer 18.

The bottom layer 18 of the wood floor plank 8, FIGS. 4A and 5, comprises a four sided tongue and grove construction to facilitate installation. A tongue 23 is formed along the entire length of one longitudinal side of the bottom layer 18. A groove 25 is cut in the bottom layer 18 and the groove 25 extends along the entire length on the opposing longitudinal side of the bottom layer 18. The groove 25 sized and shaped to receive a tongue 23 from another wood floor plank 8. The floor plank 8 also features tongue and groove construction on the butt end of each plank 8 in order to assure the interlocking of wood floor planks 8 abutting one another. A tongue 26, FIG. 3, is formed along the entire length of one end of the bottom layer 18. A groove 27, FIG. 3, is cut in the bottom layer 18 along the entire length on the opposing butt end and is sized and shaped to mate with a tongue 26 of another wood floor plank 8 during installation. The tongues 23 and 26 and grooves 25 and 27 are formed and cut, respectively, only in the bottom layer 18.

The wood flooring plank 8 further comprises kerfs 28A-E on the bottom surface 20 of the bottom layer 18. The kerfs 28A-E add dimensional flexibility to the plank 8. There are typically five kerfs 28A-E on the bottom surface 20 of the bottom layer 18. One edge kerr 28A is cut approximately one inch from one of the longitudinal sides of the bottom surface 20 of the bottom layer 18 for the entire length of the bottom surface 20. Another edge kerf 28E is cut approximately one inch from one of the opposing longitudinal sides of the bottom surface 20 of the bottom layer 18 for the entire length of the bottom surface 20. The balance of central kerfs 28B, 28C, and 28D are equally spaced between the two edge kerts, 28A and 28E. Each kerf 28A-E has a width ranging from 3 millimeters to 6 millimeters and a depth ranging from 6 millimeters to 13 millimeters. The kerfs 28A-E effectively reduce the physical strength of the solid wood floor plank 8, and thus add flexibility by allowing the plank 8 to better conform to slight irregularities in sub-floor surfaces.

The wood flooring plank 8 bottom layer 18 includes a bevel 30, FIGS. 4A and 4B. The bevel 30 is cut 1 millimeter back on both sides along the entire length of the wood flooring plank 8, at the lower edge of the bottom layer 18 of the bottom surface 20. The bevel 30 is used to create a space to accommodate hydroscopic expansion from the bottom layer 18.

One clear coat of a non-toxic, ultra-violet cured urethane finish is applied to the entire bottom surface 20 of the bottom layer 18. This coat provides additional moisture protection for the bottom layer 18, which increases dimensional stability for the entire wood floor plank 8.

As can be seen from the foregoing, the improved wood flooring product provides a dimensionally stable, thick hardwood wear layer which can be installed over any sub-floor surface, particularly concrete.

Due to increased dimensional stability, the improved wood flooring product can be manufactured in longer and wider boards, typically 7 feet long by 7 inches wide which can be glued directly to concrete slabs. The consumer finishing-out a home with a concrete slab foundation can use the same flooring product on any level of the home, since the first floor can be glued to concrete and the second and higher floors can be nailed to wood sub-flooring. Similarly, consumers finishing-out multi-level high-rise apartment and condominiums living spaces with concrete slab flooring throughout can enjoy quality wood floors on all levels of their home. The longer and wider boards of the improved wood product also allow for faster installation.

For the purposes of promoting an understanding of the principles of the improved flooring product and system, reference will now be made to the embodiments illustrated in the drawings and specific language will be used to describe the same. It will nevertheless be understood that no limitation of the scope of the flooring product or system is thereby intended, such alterations and further modifications in the illustrated embodiments, and such further applications of the principles of the flooring product or system as illustrated therein being contemplated as would normally occur to one skilled in the art to which the disclosure relates.

It should be understood that the improved wood flooring product and system are not intended to be limited by the specifics of the above-described embodiments, but rather by the accompanying claims.

I claim:

1. An improved hardwood flooring plank for assembly into a hardwood floor comprising a plurality of like planks, each plank comprising:

a solid hardwood wear layer having length from one foot to eight feet, width from two inches to ten inches, and thickness from two millimeters to eight millimeters, having top and bottom surfaces, the top surface coated with five to nine coats of non-toxic ultraviolet cured urethane base finish and further comprising a micro-bevel around the entire top surface perimeter, the micro-bevel cut at a forty-five degree angle and 0.5 millimeter in width and depth; and a bottom layer comprising a plurality of solid hardwood strips of uniform dimension adhesively attached one to another in a finger-jointed formation to provide a uniformly planar top surface, a uniformly planar bottom surface, butt end surfaces, and longitudinal side surfaces, the bottom layer top side surface to receive and support the wear layer by adhesive bonding to the wear layer bottom surface, the strips having generally uniform square or rectangular cross-sections with thicknesses ranging from a quarter inch to three-quarters of an inch and widths ranging from half an inch to two inches and lengths from four inches to thirty inches arranged with the same grain orientation as the wear layer and running longitudinally the length of the top layer, the bottom layer bottom side surface further comprising a plurality of evenly spaced kerfs running parallel the length of the bottom side surface, with outside kerfs of the evenly spaced kerfs typically spaced one inch from each respective bottom layer longitudinal side surface, the kerfs having widths ranging from 3 millimeters to 6 millimeters and depths ranging from 6 millimeters to 13 millimeters, the bottom layer longitudinal side surfaces and butt end surfaces further comprising tongue and groove fittings to facilitate bottom layer interconnection between like constructed planks, the bottom layer bottom side surface further comprising one clear coat of non-toxic ultraviolet cured urethane finish, and the bottom layer side surfaces further comprising a bevel cut back 1 millimeter on both sides of the entire length of the bottom layer side surfaces.

* * * * *